US006536534B1

(12) United States Patent
Sundholm

(10) Patent No.: US 6,536,534 B1
(45) Date of Patent: Mar. 25, 2003

(54) HOLDER FOR MOUNTING A SPRAY HEAD

(75) Inventor: Göran Sundholm, Tuusula (FI)

(73) Assignee: Marioff Corporation Oy, Vantaa (FI)

( * ) Notice: Subject to any disclaimer, the term of this patent is extended or adjusted under 35 U.S.C. 154(b) by 382 days.

(21) Appl. No.: 09/367,972

(22) PCT Filed: Jan. 7, 1999

(86) PCT No.: PCT/FI99/00007

§ 371 (c)(1),
(2), (4) Date: Sep. 7, 1999

(87) PCT Pub. No.: WO99/34872

PCT Pub. Date: Jul. 15, 1999

(30) Foreign Application Priority Data

Jan. 9, 1998 (FI) ..... 980034

(51) Int. Cl.[7] ..... A62C 37/08; B05B 1/30
(52) U.S. Cl. ..... 169/37; 239/579
(58) Field of Search ..... 169/37, 90, 16; 239/572, 579, 569, 570, 178; 251/149.6, 149.1, 149.4; 137/614.05, 329.2

(56) References Cited

U.S. PATENT DOCUMENTS

| | | | | | |
|---|---|---|---|---|---|
| 629,304 | A | * | 7/1899 | Rawlins | 137/329.2 |
| 951,519 | A | * | 3/1910 | Bacigalupi | 251/149.6 |
| 1,268,160 | A | * | 6/1918 | Sammons | 137/614.05 |
| 1,432,386 | A | * | 10/1922 | Curney | 169/37 |
| 1,740,015 | A | * | 12/1929 | Hooper et al. | 251/149.6 |
| 3,750,954 | A | * | 8/1973 | Williams | 239/178 |
| 4,562,962 | A | * | 1/1986 | Hartman | 239/569 |
| 4,944,327 | A | * | 7/1990 | Gyben | 239/572 |
| 5,174,500 | A | * | 12/1992 | Yianilos | 239/570 |
| 5,324,265 | A | | 6/1994 | Murray | 604/110 |
| 5,335,857 | A | * | 8/1994 | Hagon | 239/204 |
| 5,415,239 | A | * | 5/1995 | Kotter et al. | 169/37 |
| 5,485,982 | A | | 1/1996 | Gunderson | 251/149.6 |
| 5,524,824 | A | * | 6/1996 | Frimmer | 239/569 |
| 5,533,576 | A | | 7/1996 | Mears | 169/90 |
| 5,577,706 | A | * | 11/1996 | King | 251/149.6 |
| 5,762,319 | A | | 6/1998 | Kopp | 251/149.6 |
| 6,024,175 | A | * | 2/2000 | Moore, Jr. et al. | 169/37 |

FOREIGN PATENT DOCUMENTS

| | | |
|---|---|---|
| WO | 9100240 | 1/1991 |
| WO | 9201188 | 1/1992 |
| WO | 9615820 | 5/1996 |

* cited by examiner

*Primary Examiner*—Michael Mar
*Assistant Examiner*—Dinh Q. Nguyen
(74) *Attorney, Agent, or Firm*—Ladas & Parry

(57) ABSTRACT

The invention relates to a holder (1) for mounting a spray head for fire fighting, which holder comprises a body (8), a first end (9), a second end (10) and a passage (11) between the first and the second end for conducting extinguishing medium from the first end to the second end, a channel (17) at the second end of the body for receiving the spray head in such a way that a housing (18) of the spray head is inserted into the channel, the first end being intended to receive a conduit (3) for conducting extinguishing medium. For the purpose of preventing extinguishing medium from flowing out of the conduit (3) leading to the spray head, when this is detached from the holder (1), the holder comprises a displaceable element (12) mounted in the passage (11), which element is displaceable from a first position, in which the element closes the passage, to a second position, in which the element keeps the passage open, the element being arranged to be in the first position, when the spray head is not mounted, and to be displaced to the second position, when the spray head is mounted to the holder. The invention also relates to a combination of a holder and a spray head.

31 Claims, 3 Drawing Sheets

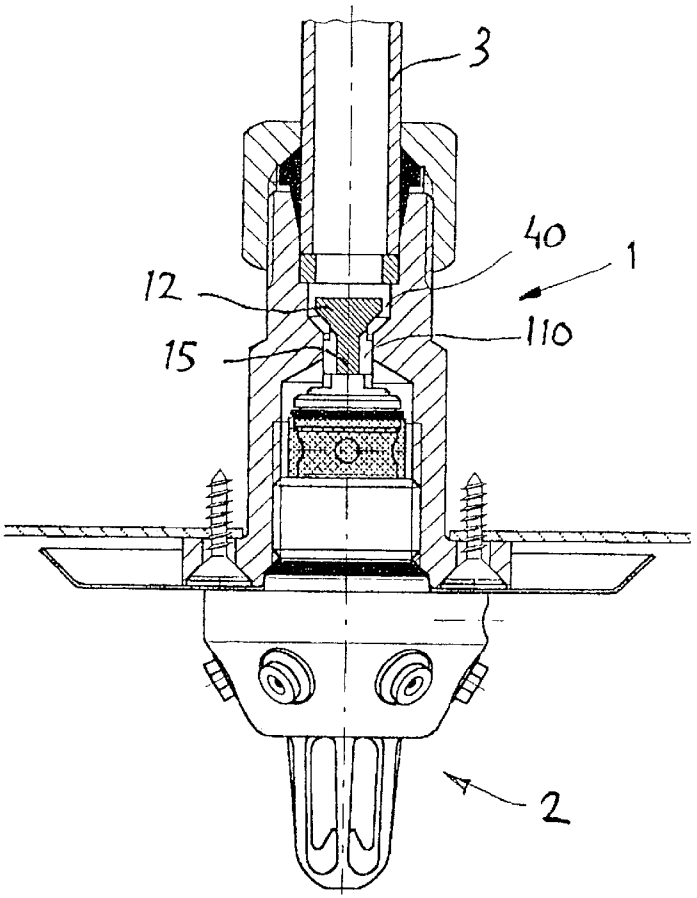
FIG. 3
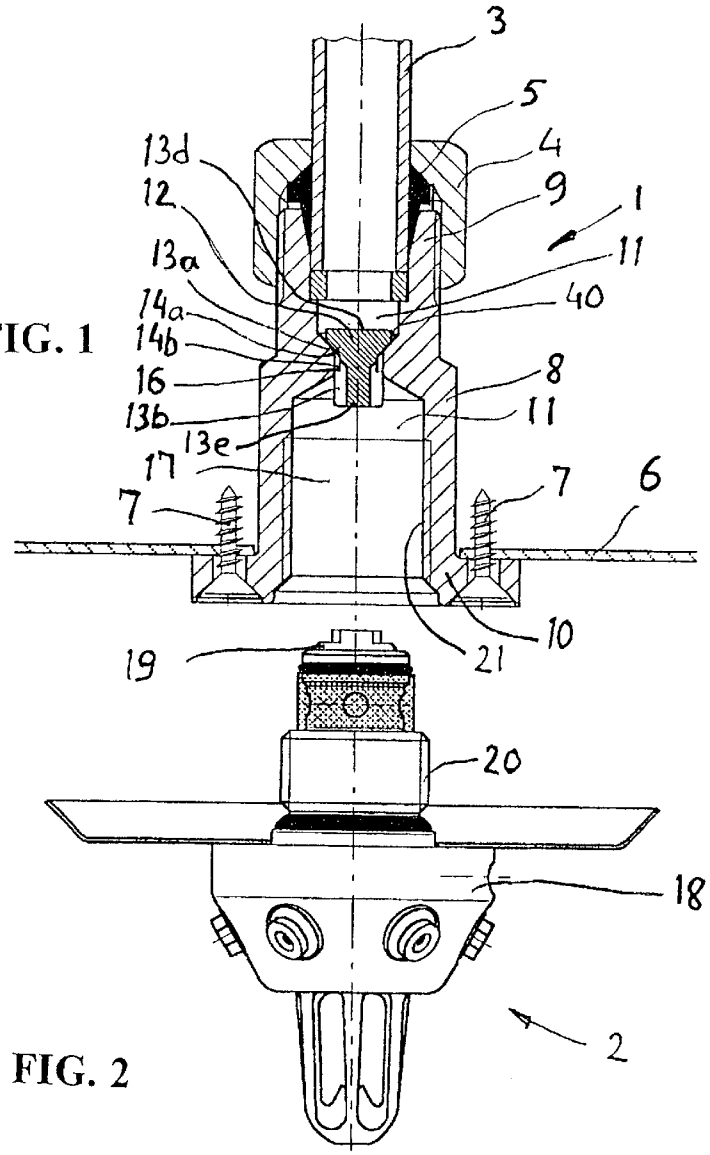
FIG. 1
FIG. 2

HOLDER FOR MOUNTING A SPRAY HEAD

BACKGROUND OF THE INVENTION

The invention relates to a holder for mounting a spray head for fire fighting, comprising a body, a first end, a second end and a passage between the first and the second end for conducting extinguishing medium from the first end to the second end, a channel at the second end of the body for receiving the spray head in such a way that a housing of the spray head is inserted into the channel, the first end being intended to receive a conduit for supplying extinguishing medium. The holder can also be called a mounting part of a spray head.

A holder of the above type is known from the publication WO 95/31252, for instance. The holder is typically mounted on a ceiling, but can be mounted on a wall, alternatively.

SE 504 325 discloses a release device intended for a sprinkler head, facilitating function testing and comprising a remote-control pilot piston, which is, also in case of intact fuse, arranged to keep the passage between the inlet and the nozzle closed or open, respectively, depending on the position of the pilot piston.

More specifically, the present invention relates to a holder according to the preamble of the attached claim 1 and to a combination of a holder and a spray head according to the preamble of the attached claim 10.

Spray heads and sprinklers, i.e. spray heads with built-in release means, are pressure tested or tested in another manner to secure their function in case of fire. After the tests, the sprinklers and/or spray heads are unscrewed from their respective holder to carry out possible adjustments and—if sprinklers are used—to replace the release means damaged at release, such as a broken glass ampoule, for instance.

After the sprinklers or spray heads have been tested, extinguishing medium remains in the conduit (for supplying extinguishing medium), though a section valve controlling the flow of extinguishing medium to the sprinklers or spray heads is closed. When the spray head or sprinkler is being unscrewed, the extinguishing medium remained in the conduit conducting the extinguishing medium to the spray head flows out.

The above implies that—if water is used as extinguishing medium—water flows on the floor or on some other undesired place. Because the conduits may be very long, the amount of water flowing out will be great. To prevent water damages, this water has to be dried up, or alternatively, a big container is needed, in which the water is collected. A further drawback of this water flow is that the person testing the sprinklers or spray heads is easily subjected to water spraying.

BRIEF DESCRIPTION OF THE INVENTION

The object of the invention is to solve said drawbacks. This object is achieved by means of a holder for mounting a spray head for fire fighting, comprising a body, a first end, a second end, and a passage between the first and the second end for conducting extinguishing medium from the first end to the second end, a channel at the second end of the body for receiving the spray head in such a way that a housing of the spray head is inserted into the channel, the first end being intended to receive a conduit for supplying extinguishing medium, and the holder comprising a displaceable element mounted in the passage, which element can be displaced from a first position, in which the element closes the passage, to a second position, in which the element keeps the passage open, the holder being characterized in that the element is arranged to be in the first position when the spray head is not mounted and to be displaced to the second position when the spray head is being mounted to the holder.

Preferred embodiments of the holder are presented in the attached claims 2 to 9.

According to the invention, a combination of a holder and a spray head is characterized in what is set forth in the characterizing portion of the attached claim 10.

The invention is essentially based on the idea to provide a construction in which a flow of water or other extinguishing medium out of the conduit leading to the spray head (or sprinkler) is automatically prevented upon the spray head or sprinkler being detached from its holder and in which the water flow is possible when the spray head (or sprinkler) is mounted to its holder. In other words, the invention relates to a valve of a holder for a spray head (or sprinkler) for fire fighting, the functional position of the valve being controlled depending on whether the spray head (or sprinkler) is mounted to the holder or not. When the spray head is not mounted, the valve gets into a blocking position on account of the fact that 1) force of gravity acts on the valve, 2) pressure of extinguishing medium acts on the valve, or 3) an element, such as a spring, acts on the valve. Naturally, the blocking position can also be provided as a result of a combination of said reasons.

The greatest advantages of the invention are that it prevents extinguishing medium, e.g. water, from flowing out of conduits leading to sprinklers and spray heads, when sprinklers and spray heads are detached from their respective holders, and thus prevents considerable amounts of extinguishing medium from flowing out in places where the extinguishing medium may cause damage.

DETAILED DESCRIPTION OF THE INVENTION

In the following, the invention will be described in more detail by means of two embodiments with reference to the attached drawing, in which:

FIG. 1 shows a first embodiment of a holder according to the invention in a first position;

FIG. 2 shows a sprinkler to be mounted to the holder of FIG. 1;

FIG. 3 shows the holder of FIG. 1 in a second position and the sprinkler of FIG. 2 mounted to the holder;

DETAILED DESCRIPTION OF THE INVENTION

Figure 4:
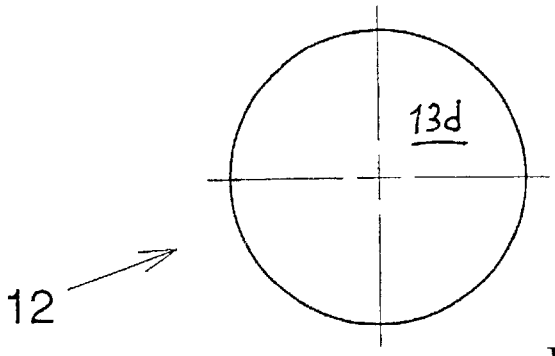
FIGS. 4 to 6 show a detail of the holder of FIG. 1 from above, from the side and from below, respectively.

FIG. 1 shows a mounting part or a holder 1 for a spray head for fire fighting. By means of the mounting part, the spray head can be mounted on a panel, for instance. The spray head may comprise an ampoule or another member, which is broken or which changes its shape at heat to make the spray head release, whereby the spray head together with said member forms a sprinkler. Such a sprinkler 2 is shown in FIG. 2.

In FIG. 1, the holder 1 is mounted on a panel 6 by means of screws 7 or corresponding fastening members. The panel 6 may typically constitute a ceiling. Instead of mounting the holder 1 horizontally, as shown in FIG. 1, the holder can be mounted on a vertical surface or a slanting surface. A conduit 3 for supplying extinguishing medium mounted in the holder 1 is also drawn in FIG. 1. The conduit 3 is kept mounted by means of a threaded part 4. The reference numeral 5 indicates a sealing.

The holder 1 comprises a body 8, a first end 9 for receiving the conduit 3, and a second end 10 for receiving the sprinkler 2. A passage 11 for extinguishing medium, e.g. water, leads from the first end 9 to the second end 10. In FIG. 1, the passage is blocked by a valve element 12, which is kept in the position shown in FIG. 1 by its weight, i.e. by means of gravitation. Alternatively, a pressure in the conduit 3 can keep the valve element 12 sealingly in place by exposing a pressure surface 13*d* of the valve element to a force. An actuating surface 13*e*, opposite to the pressure surface 13*d*, is formed at a lower end of the valve element 12. This actuating surface 13*e* works in cooperation with the sprinkler 2, for opening the passage 11, which will be described later.

Figure 5:
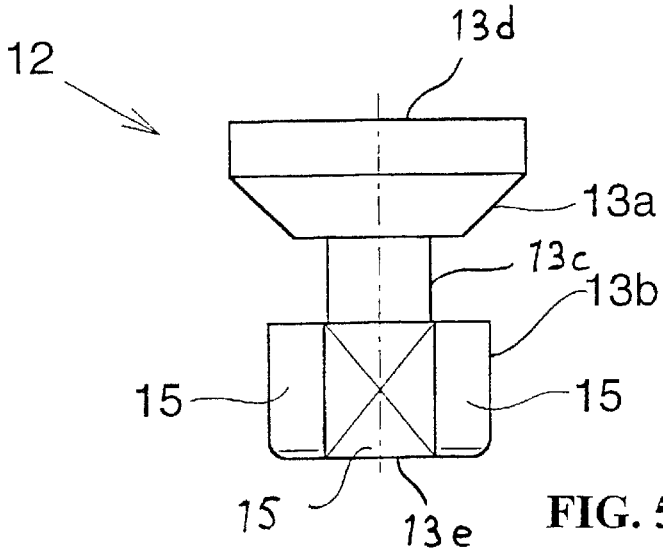
Figure 6:
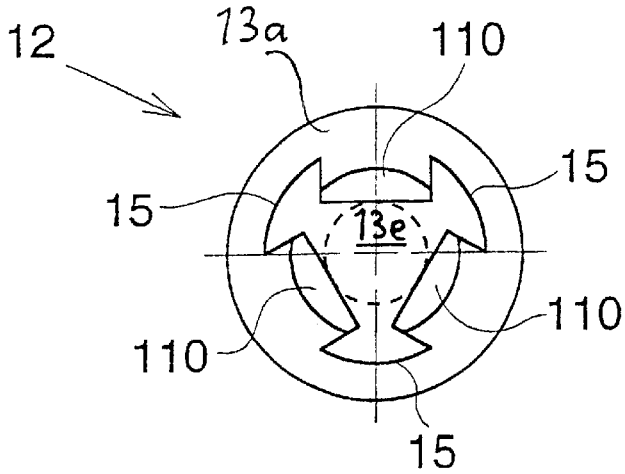

FIGS. 4, 5 and 6 show the valve element 12 from above, from the side and from below.

The valve element 12 comprises a conically tapering portion 13*a*, which changes over to a guide portion 13*b* having a waist portion 13*c* and a wider portion with three projections 15, between which there are grooves 110, see FIGS. 5 and 6. The passage 11 (see FIG. 1) comprises a conically tapering seat 14*a*, whose shape corresponds to the conically tapering portion 13*a* of the valve element 12, and a cylindrical portion 14*b* for receiving the projections 15 of the guide portion. The conically tapering portion 13*a* constitutes together with the conically tapering seat 14*a* a sealing composed of a sealing surface or a sealing line blocking the passage 11.

Thanks to the guide portion 13*b*, the valve element 12 will be guided in the longitudinal direction of the passage 11. The cylindrical portion 14*b* of the passage 11 may be provided with shallow grooves 16 receiving the projections 15 of the valve element, in which case the valve element 12 can be kept steadily in place also when the passage 11 is open, cf. FIG. 3. This is the case also when the holder 1 is mounted in a horizontal position.

From FIGS. 1 and 3 appears that a slot 40 is formed between the conically tapering portion 13*a* and the wall of the surrounding passage 11 even at the place where the diameter of the conically tapering portion is biggest. The grooves 110 of the guide portion 13*b* form channels for the flow of extinguishing medium past the slot 40 and the valve element 12 when this is in the open position, cf. FIGS. 3 and 5. A flow of extinguishing medium past the slot 40 through the valve element 12 can also be provided (when the valve element is in the open position) by making the grooves 16 bigger than the projections 15 in such a way that the grooves 16 constitute passages for extinguishing medium.

The above shows that the shape of the guide portion 13*b* may vary in many ways: for instance, a waist portion is not absolutely necessary, though such a portion enables an efficient flow of extinguishing medium in spite of small size of the valve element 12. It is also conceivable that the end of the valve element 12 which faces the first end 9 of the holder is guided by the passage 11. Hereby, either the guide portion of the valve element or the passage is provided with grooves enabling a flow of extinguishing medium. In the latter case, the valve element 12 does not need any guide portion facing the second end 10 of the holder, but can have a guide portion at its end facing the first end 9 of the holder.

The cross-sectional area of the cylindrical portion 14*b* constitutes about 3 to 30% of the cross-sectional area of the passage 11.

It is also conceivable that one or more channels (not shown) are formed in the wall constituting the passage 11, which channels are opened by the valve element 12 being displaced to the position of FIG. 3. Such a channel could replace the grooves 110 of the valve element 12 for the purpose of enabling a flow of extinguishing medium from the first end 9 of the holder to its second end 10.

The lower end of the passage 11 is constituted by a channel 17 for receiving the sprinkler 2, see FIGS. 1 and 2. The sprinkler 2 comprises a housing 18 with an upper end 19. The sprinkler 2 is screwed in place by means of threads 21 formed in the channel 17 of the holder 1. Instead of threads, some other means, e.g. bayonet connection or other quick-coupling means, can be used for fastening the sprinkler to the holder. When the sprinkler 2 is being mounted to the holder 1, the upper end 19 of the housing 18 presses against the actuating surface 13*e* and thus lifts the valve element 12 from the position shown in FIG. 1 to the position shown in FIG. 3. Hereby, the passage 11 is opened and extinguishing medium may flow from the conduit 3 into the sprinkler 2. The expression actuating surface 13*e* signifies any type of actuating surface, which also can have a very small area. Thus, the actuating surface can be a point or a line (in FIG. 9, the actuating surface is formed of a point).

Figure 7:
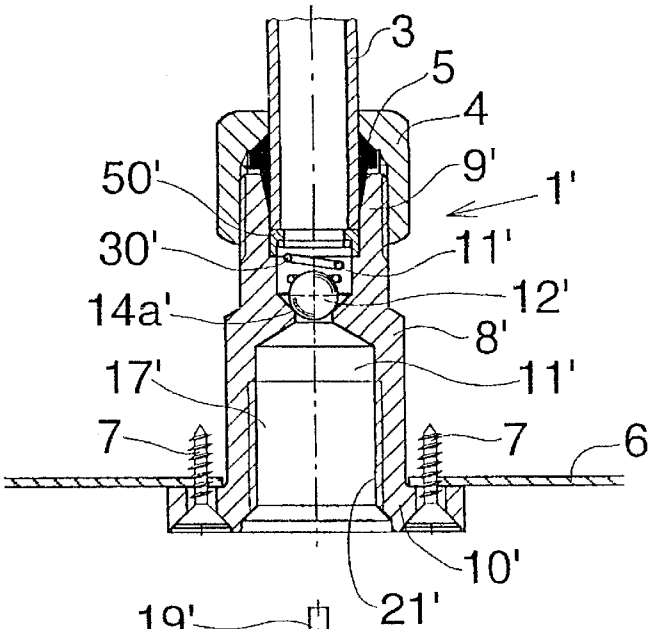
FIG. 7 shows a second embodiment of the holder according to the invention in a first position corresponding to the position of FIG. 1.
Figure 8:
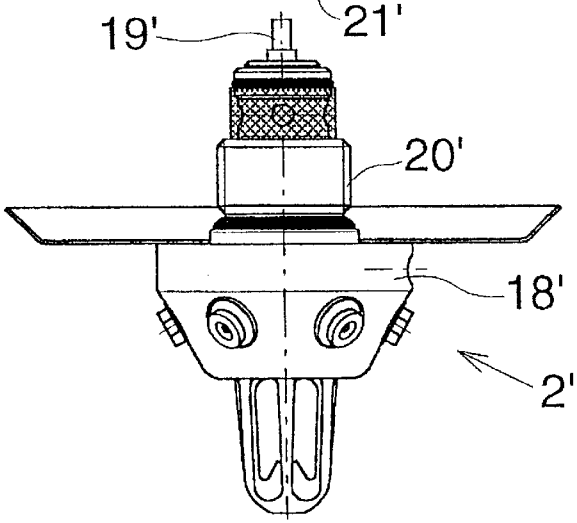
FIG. 8 shows a sprinkler to be mounted to the holder of FIG. 7.

FIG. 7 shows another embodiment of the holder 1' according to the invention. The holder 1' of FIG. 7 differs from the holder of FIG. 1 therein that it comprises, instead of a conically tapering valve element, a ball 12' loaded by a spring 30'. The ball 12' has a smaller diameter than the surrounding passage 11 so that there is a slot 40' between the ball and the wall of the surrounding channel. The spring 30' is a helical spring comprising a first end and a second end, the first end of the spring bearing against the ball 12' and the second end of the spring bearing against a ring element 50 in the passage 11'. In the FIGS. 7 to 9, similar parts of the holder and the sprinkler are indicated by reference numerals formed by adding an apostrophe to the reference numerals used in the FIGS. 1 to 3. The spring 30' is not necessary, but, thanks to the spring, the ball 12' stays in the blocking position shown in FIG. 1, though the holder 1' is mounted in a position differing from the vertical position. Though the valve element 12, 12' is arranged to be in a slanting position by exposing the valve element to a force by the pressure of the extinguishing medium, there is a possibility that the valve element allows extinguishing medium to pass when the holder is mounted in a horizontal or slanting position, if there is no spring 30'. The spring 30' secures also that the ball 12' does not start rotating so as to disturb the flow of extinguishing medium in the passage 11', when the ball is in the position with the passage open.

Figure 9:
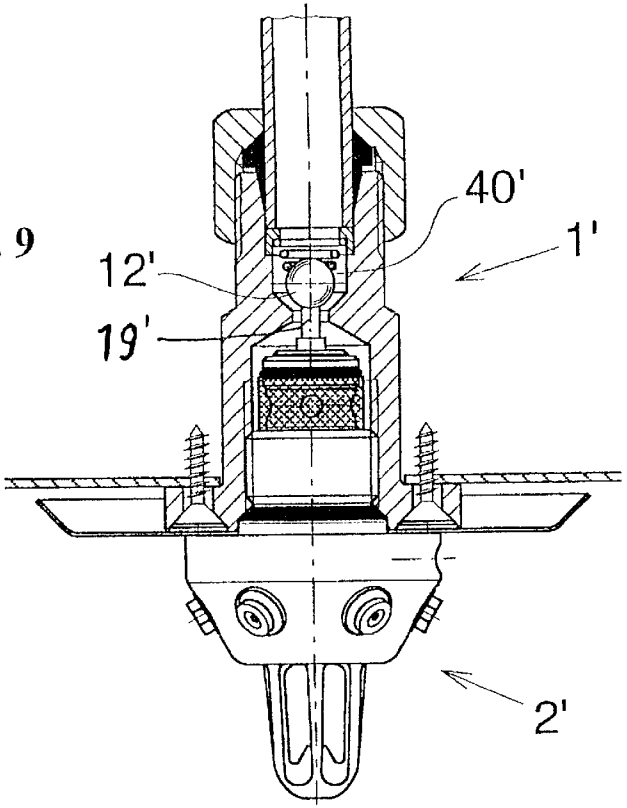
FIG. 9 shows the holder of FIG. 7 in a second position and the sprinkler of FIG. 8 mounted to the holder.

From FIG. 9 appears that the upper end 19' of the sprinkler shall be sufficiently long to be able to displace the ball 12' to a position with the passage 11' open.

The invention has been described above by means of two examples only, and therefore, it is pointed out that the details of the invention may differ in many ways within the scope of the attached claims. Accordingly, the shape of the displaceable element 12, 12' may differ from an element having a conical portion or from a ball-shaped element. Instead of the element 12, 12' being mounted centrally in the passage 11, 11', it is conceivable that the element is built in the wall of the body 8, 8' of the holder. In the latter case, it is conceivable to a person skilled in the art that some other part of the housing 18, 18' of the sprinkler than the upper end 19, 19' of the sprinkler could attend to that the element will be displaced from the closing position to the opening position.

What is claimed is:

1. A holder (1) for mounting a spray head (2) for fire fighting, the holder comprising:

a body (8) having a first end (9), a second end (10), and a passage (11) between the first end and the second end for conducting extinguishing medium from the first end to the second end, the first end being arranged to receive a conduit for supplying the extinguishing medium;

a channel (17) at the second end of the body for receiving a housing (18) of a spray head; and a displaceable element (12) mounted in the passage (11) for displacement from a first position in which the element closes the passage to a second position in which the element keeps the passage open, wherein the element (12) is arranged to be in the first position when the housing (18) is not received and to be displaced to the second position when the housing (18) is received, wherein the element (12) comprises a conically tapering portion (13*a*) for bearing against a conically tapering seat (14*a*) arranged in the passage (11), the portion of the element (12) together with the seat constituting a sealing surface preventing extinguishing medium from flowing from the first end (9) to the second end (10) when the housing (18) is not received, the portion of the element (12) being arranged to be displaced from the seat and to open a connection between the first end and the second end when the housing (18) is received, and wherein the element (12) comprises radial projections (15) extending from a portion (13*b*) thereof and the passage (11) comprises grooves (16) for receiving the projections in the grooves.

2. A holder according to claim 1, characterized in that the element (12, 12') is arranged to be displaced to the second position by exposing the element to a force by the housing (18, 18') of the spray head, when the spray head (2, 2') is being mounted to the holder (1, 1').

3. A holder according to claim 1, characterized in that the element (12) comprises a pressure surface (13*d*) to be exposed to the pressure of extinguishing medium prevailing in the passage, said pressure exposing the element to a force keeping the element in the first position, when the spray head (2) is not mounted.

4. A holder according to claim 1, characterized in that the element (12') is arranged to be in the first position by means of a spring (30') exposing the element to a force, when the spray head (2') is not mounted.

5. A holder according to claim 1, characterized in that the element (12, 12') is arranged to be in the first position by means of gravitation, when the spray head (2, 2') is not mounted.

6. A holder according to claim 1, characterized in that the element comprises a ball (12') for bearing against a seat (14*a*') arranged in the body (18') of the spray head, which ball and which seat together constitute a sealing preventing extinguishing medium from flowing from the first end (9') of the holder to its second end (10'), when the spray head (2') is not mounted, which ball is arranged to be displaced from the seat and to open the passage (11) between the first end of the holder and its second end, when the spray head is being mounted.

7. A holder according to claim 1, wherein the conically tapering portion (13*a*) tapers towards the channel (17) and changes over to a guide portion (13*b*), the guide portion comprising at least one channel (110) for keeping the passage (11) between the first end (9) and the second end (10) open when the housing is received.

8. A combination of a holder (1, 1') and a housing (18, 18') of a spray head (2, 2') for discharging extinguishing medium for fire fighting, the holder comprising a body (8, 8') having a first end (9, 9'), an opposite second end (10, 10'), a passage (11, 11') between the first and second ends for conducting the extinguishing medium from the first end to the second end, and a channel (17, 17') at the second end for receiving the housing (18, 18'), the first end (9, 9') being for receiving the extinguishing medium, and a displaceable element (12, 12') mounted in the passage (11, 11') for displacement from a first position in which the element closes the passage to a second position in which the element keeps the passage open, wherein the element (12, 12') is in the first position when the housing (18, 18') is not received in the channel (17, 17'), and the second position when the housing is received in the channel (17, 17').

9. A holder (1) for mounting a spray head (2) for fire fighting, the holder comprising:

a body (8) having a first end (9), a second end (10), and a passage (11) between the first end and the second end for conducting extinguishing medium from the first end to the second end, the first end being arranged to receive a conduit for supplying the extinguishing medium;

a channel (17) at the second end of the body for receiving a housing (18) of a spray head; and a displaceable element (12) mounted in the passage (11) for displacement from a first position in which the element closes the passage to a second position in which the element keeps the passage open, wherein the element (12) is arranged to be in the first position when the housing (18) is not received and to be displaced to the second position when the housing (18) is received, wherein the element (12) comprises a conically tapering portion (13*a*) for bearing against a conically tapering seat (14*a*) arranged in the passage (11), the portion of the element (12) together with the seat constituting a sealing surface preventing extinguishing medium from flowing from the first end (9) to the second end (10) when the housing (18) is not received, the portion of the element (12) being arranged to be displaced from the seat and to open a connection between the first end and the second end when the housing (18) is received, and wherein the conically tapering portion (13*a*) tapers towards the channel (17) and changes over to a guide portion (13*b*), which comprises at least one channel (110) for keeping the passage (11) between the first end (9) and the second end (10) open when the housing is received.

10. A holder according to claim 9, wherein the element (12) comprises radial projections (15) extending from a portion (13*b*) thereof and the passage (11) comprises grooves (16) for receiving the projections in the grooves.

11. A holder according to claim 9, wherein the element (12) is arranged to be displaced to the second position by exposing the element to a force from the housing (18) when the housing is received in the holder.

12. A holder according to claim 9, wherein the element (12) comprises a pressure surface (13*d*) exposed to pressure of the extinguishing medium in the passage (11) for keeping the element (12) in the first position when the housing is not received.

13. A holder according to claim 9, wherein a spring (30') urges the element (12') to the first position when the housing (18') is not received.

14. A holder according to claim 9, wherein the element is arranged to be in the first position by gravitation when the housing (18) is not received.

15. A holder according to claim 9, wherein the element (12) comprises a conically tapering portion (13*a*) for bearing against a conically tapering seat (14*a*) arranged in the passage (11), the portion of the element (112) together with the seat constituting a seal for preventing the extinguishing medium from flowing from the first end (9) to the second end (10) when the housing (18) is not received, the portion of the element (12) being arranged to be displaced from the seat and to open a connection between the first end and the second end when the housing is received.

16. A holder according to claim 9, wherein the element comprises a ball (12') for bearing against a seat (14*a*') arranged in the body (18'), the ball and seat together constituting a seal preventing extinguishing medium from flowing from the first end (9') to the second end (10') when the spray head (2') is not mounted, the ball being arranged to be displaced from the seat and to open the passage (11) between the first end and the second end when the spray head is being mounted.

17. A holder (1) for mounting a spray head (2) for fire fighting, the holder comprising:

a body (8) having a first end (9), a second end (10), and a passage (11) between the first end and the second end for conducting extinguishing medium from the first end to the second end, the first end being arranged to receive a conduit for supplying the extinguishing medium;

a channel (17) at the second end of the body for receiving a housing (18) of a spray head; and a displaceable element (12) mounted in the passage (11) for displacement from a first position in which the element closes the passage to a second position in which the element keeps the passage open, wherein the element (12) is arranged to be in the first position when the housing (18) is not received and to be displaced to the second position when the housing (18) is received, and wherein the first end (9) is arranged to receive the conduit with threads.

18. A holder according to claim 17, characterized in that the element (12) comprises a conically tapering portion (13*a*) for bearing against a conically tapering seat (14*a*) arranged in the passage (11) of the holder, which portion together with the seat constitutes a sealing surface preventing extinguishing medium from flowing from the first end (9) of the holder to its second end (10), when the spray head (2) is not mounted, which portion is arranged to be displaced from the seat and to open a connection between the first end and the second end of the holder, when the spray head is being mounted.

19. A holder according to claim 18, characterized in that the element (12) comprises radial projections (15) extending from a portion (13*b*) thereof and that the passage (11) comprises grooves (16) for receiving the projections in such a way that these are inserted into the grooves.

20. A holder according to claim 18, characterized in that the conically tapering portion (13*a*) tapers towards the channel (17) and changes over to a guide portion (13*b*), which comprises at least one channel (110) keeping the passage (11) between the first end (9) and the second end (10) of the holder open, when the spray head is mounted.

21. A holder according to claim 17, wherein the element (12) is arranged to be displaced to the second position by exposing the element to a force from the housing (18) when the housing is received in the holder.

22. A holder according to claim 17, wherein the element (12) comprises a pressure surface (13*d*) exposed to pressure of the extinguishing medium in the passage (11) for keeping the element (12) in the first position when the housing is not received.

23. A holder according to claim 17, wherein a spring (30') urges the element (12') to the first position when the housing (18') is not received.

24. A holder according to claim 17, wherein the element is arranged to be in the first position by gravitation when the housing (18) is not received.

25. A holder according to claim 19, wherein the element comprises a ball (12') for bearing against a seat (14*a*') arranged in the body (18'), the ball and seat together constituting a seal preventing extinguishing medium from flowing from the first end (9') to the second end (10') when the spray head (2') is not mounted, the ball being arranged to be displaced from the seat and to open the passage (11) between the first end and the second end when the spray head is being mounted.

26. A holder according to claim 17, wherein the element (12) comprises a conically tapering portion (13*a*) for bearing against a conically tapering seat (14*a*) arranged in the passage (11), the portion of the element (12) together with the seat constituting a seal for preventing the extinguishing medium from flowing from the first end (9) to the second end (10) when the housing (18) is not received, the portion of the element (12) being arranged to be displaced from the seat and to open a connection between the first end and the second end when the housing is received.

27. A holder according to claim 17, wherein the element (12) comprises radial projections (15) extending from a portion (13*b*) thereof and the passage (11) comprises grooves (16) for receiving the projections in the grooves.

28. A holder according to claim 17, wherein the conically tapering portion (13*a*) tapers towards the channel (17) and changes over to a guide portion (13*b*), the guide portion comprising at least one channel (110) for keeping the passage (11) between the first end (9) and the second end (10) open when the housing is received.

29. A holder (1') for mounting a spray head (2') for fire fighting, the holder comprising:

a body (8') having a first end (9'), a second end (10'), and a passage (11) between the first end and the second end for conducting extinguishing medium from the first end to the second end, the first end being arranged to receive a conduit for supplying the extinguishing medium;

a channel (17'), at the second end of the body for receiving a housing (18'), of a spray head; and a displaceable element (12'), mounted in the passage (11'), for displacement from a first position in which the element closes the passage to a second position in which the element keeps the passage open, wherein the element (12'), is arranged to be in the first position when the housing (18'), is not received and to be displaced to the second position when the housing (18'), is received, wherein a spring (30') urges the element (12') to the first position when the housing (18') is not received, and wherein the element comprises a ball (12') for bearing against a seat (**14*a*') arranged in the body (18'), the ball and seat together constituting a seal preventing extinguishing medium from flowing from the first end (9') to the second end (10') when the spray head (2') is not mounted, the ball being arranged to be displaced from the seat and to open the passage (11'**), between the first end and the second end when the spray head is being mounted.

30. A holder according to claim 29, wherein the element (12) is arranged to be displaced to the second position by exposing the element to a force from the housing (18) when the housing is received in the holder.

31. A holder according to claim 29, wherein the element (12) comprises a pressure surface (**13*d*) exposed to pressure of the extinguishing medium in the passage (11) for keeping the element (12**) in the first position when the housing is not received.

* * * * *